US007667410B2

(12) United States Patent
Kim et al.

(10) Patent No.: US 7,667,410 B2
(45) Date of Patent: Feb. 23, 2010

(54) EQUALIZING DISCHARGE LAMP CURRENTS IN CIRCUITS

(75) Inventors: Sangsun Kim, San Jose, CA (US); Wei Chen, Campbell, CA (US)

(73) Assignee: Monolithic Power Systems, Inc., San Jose, CA (US)

( * ) Notice: Subject to any disclaimer, the term of this patent is extended or adjusted under 35 U.S.C. 154(b) by 0 days.

(21) Appl. No.: 11/191,129

(22) Filed: Jul. 27, 2005

(65) Prior Publication Data

US 2007/0007909 A1 Jan. 11, 2007

Related U.S. Application Data

(63) Continuation-in-part of application No. 11/176,804, filed on Jul. 6, 2005, now Pat. No. 7,439,685.

(51) Int. Cl.
*H05B 41/16* (2006.01)

(52) U.S. Cl. ..... 315/274; 315/278; 315/224; 315/209 R; 315/291

(58) Field of Classification Search ..... 315/202, 315/205, 276, 277, 291, 294, 312, 313, 200 R, 315/224, 278, 274; 363/125, 126
See application file for complete search history.

(56) References Cited

U.S. PATENT DOCUMENTS

| | | | | |
|---|---|---|---|---|
| 4,567,379 | A | 1/1986 | Corey et al. | |
| 4,574,222 | A | 3/1986 | Anderson | |
| 4,902,942 | A | 2/1990 | El-Hamamsy | |
| 5,568,371 | A | 10/1996 | Pitel et al. | |
| 6,108,215 | A | 8/2000 | Kates | |
| 6,135,620 | A | 10/2000 | Marsh | |
| 6,181,066 | B1 * | 1/2001 | Adamson | 315/282 |
| 6,272,032 | B1 * | 8/2001 | Franck | 363/126 |
| 6,459,216 | B1 * | 10/2002 | Tsai | 315/294 |
| 6,616,310 | B1 | 9/2003 | Marsh | |
| 6,717,372 | B2 * | 4/2004 | Lin et al. | 315/282 |
| 6,793,381 | B2 | 9/2004 | Marsh | |
| 7,034,647 | B2 | 4/2006 | Yan et al. | |
| 7,061,188 | B1 * | 6/2006 | Katyl et al. | 315/291 |

(Continued)

FOREIGN PATENT DOCUMENTS

EP 1 517 591 * 3/2005

(Continued)

OTHER PUBLICATIONS

Kamath, et al., "A Novel, Reduced Rating Active Filter for 3-Phase, 4-Wire Loads," Dept of EE, University of Minnesota, Minneapolis, MN 55455.

(Continued)

*Primary Examiner*—Tuyet Vo
(74) *Attorney, Agent, or Firm*—Perkins Coie LLP

(57) ABSTRACT

Methods and apparatus are disclosed for balancing currents passing through multiple parallel circuit branches and in some cases through parallel fluorescent lamps. Single transformers with multiple-leg magnetic cores are wound in specific manners that simplify current balancing. Conventional three-legged EE-type magnetic cores, with disclosed windings are used to balance current in circuits with three or more parallel branches, such as parallel connected Cold Cathode Fluorescent Lamps (CCFLs).

12 Claims, 18 Drawing Sheets

Current balancing circuit for 4 lamps.

Current balancing method with a CMC

U.S. PATENT DOCUMENTS

| | | | | |
|---|---|---|---|---|
| 7,161,310 | B2 * | 1/2007 | Nishinosono et al. | 315/291 |
| 7,173,382 | B2 | 2/2007 | Ball | |
| 2004/0000879 | A1 * | 1/2004 | Lee | 315/291 |
| 2005/0093471 | A1 * | 5/2005 | Jin | 315/177 |
| 2005/0093472 | A1 | 5/2005 | Jin | |
| 2005/0093482 | A1 * | 5/2005 | Ball | 315/277 |
| 2006/0284568 | A1 * | 12/2006 | Chang et al. | 315/282 |
| 2007/0001621 | A1 * | 1/2007 | Chan et al. | 315/282 |
| 2007/0114953 | A1 * | 5/2007 | Kim et al. | 315/307 |
| 2007/0252531 | A1 * | 11/2007 | Hung et al. | 315/274 |

FOREIGN PATENT DOCUMENTS

| | | |
|---|---|---|
| JP | 2004-335443 | 11/2004 |

OTHER PUBLICATIONS

Kim, Sangsun, "Active Zero-Sequence Cancellation Technique in Unbalanced Commercial Building Power System," LITEON Inc, Power Conversion SBU, 8203 Willow Place South, Houston, TX 77070 USA.

Kim, Sangsun, "New Mulitple DC-DC Converter Topology with a High Frequency Zig-Zag Transformer," LITEON Inc, Power Conversion SBU, 8203 Willow Place South, Huston, TX 77070 USA.

Bradley, D.A., "Chapter 1: Power Semiconductors," Power Electronics, published Oct. 1995.

Dubey, G.K. et al, "2.6.2 Parallel Connection," Thyristorised Power Controllers, published Aug. 1986.

Williams, B.W., "Chapter 10: Series and Parallel Device Operation, Protection, and Interference," Power Electronics: Device, Drivers, Applications and Passive Components, published Sep. 2002.

* cited by examiner

A typical multi-lamp system driven by an inverter.

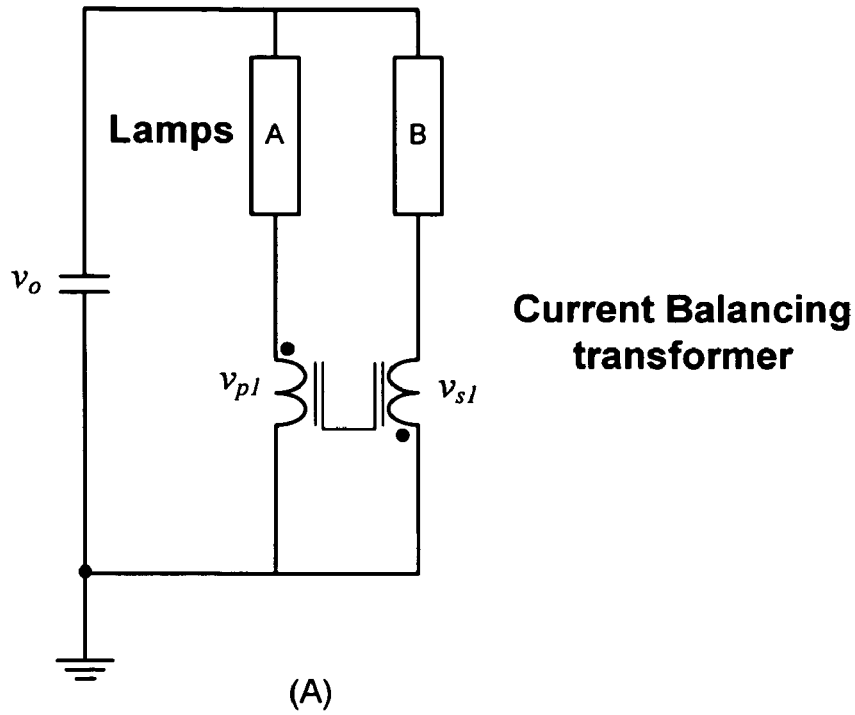
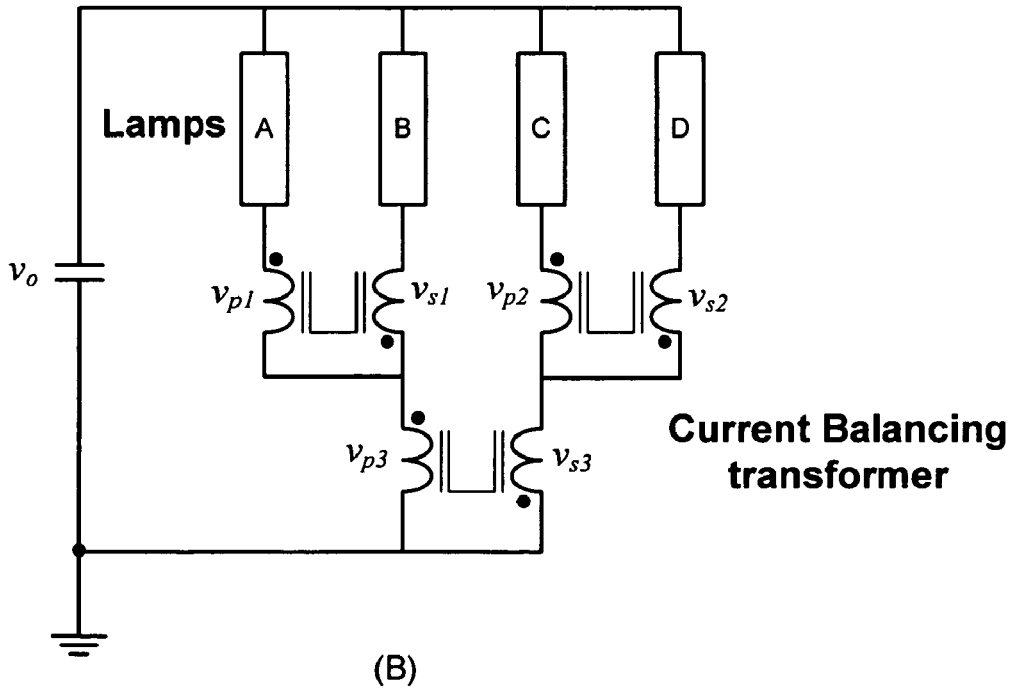
Available current balancing techniques.
*FIG. 2*

An embodiment using an integrated magnetic core for a 3-lamp system.

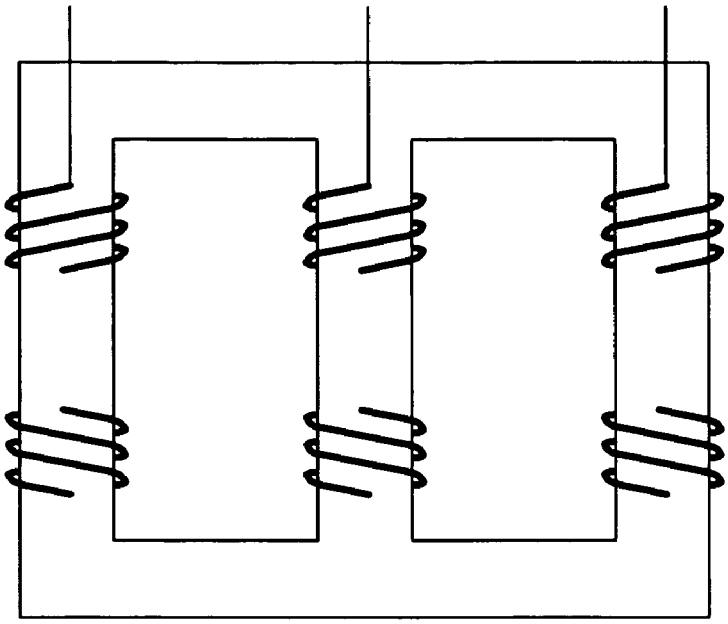
(A)
3 transformers with 6 windings (IM I)
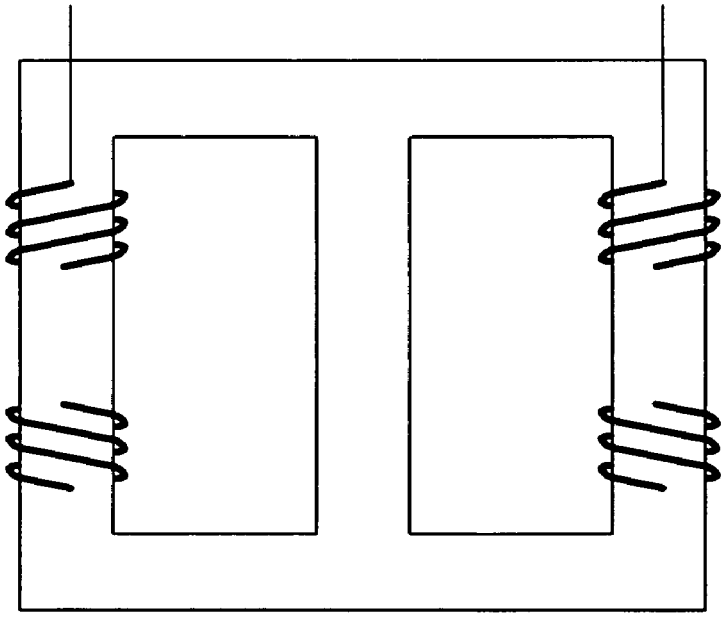
(B)
2 transformers with 4 windings (IM II)
A structure of an integrated transformer with 3 leg core.
*FIG. 4*

4 windings on a 3-leg integrated magnetic core (IM-III)

An example of a 3-Lamp Current Balancing Technique with a single magnetic core

Integrated magnetic core with star-delta configuration.

Multi-leg magnetic core with zig-zag connection.

Multi-leg magnetic core with star-delta connection.

IM(I) has N legs with 2N windings; 2 windings on each leg (N>=3).
IM(II) has more than M legs with 2M windings; 2 windings on each leg (M>=2).
Number of wound legs is SxN+TxM.

A transformer configuration for multi-lamp current balancing.

Multi-leg magnetic core with star-open delta connection.

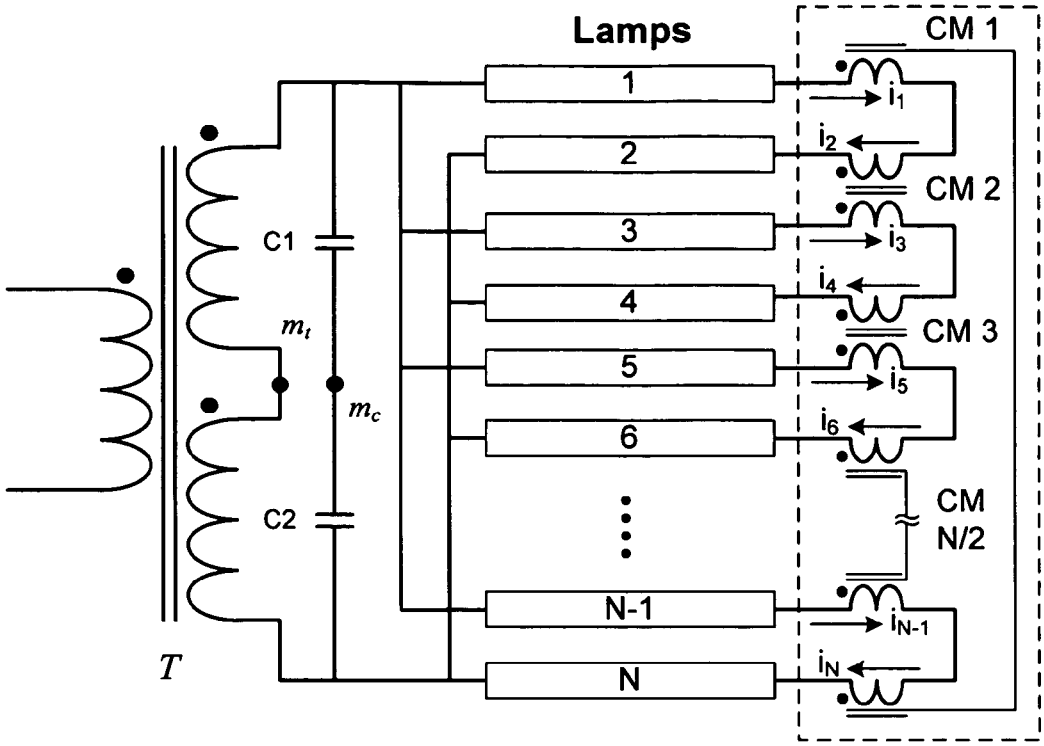
(A) The number of CMCs = N/2
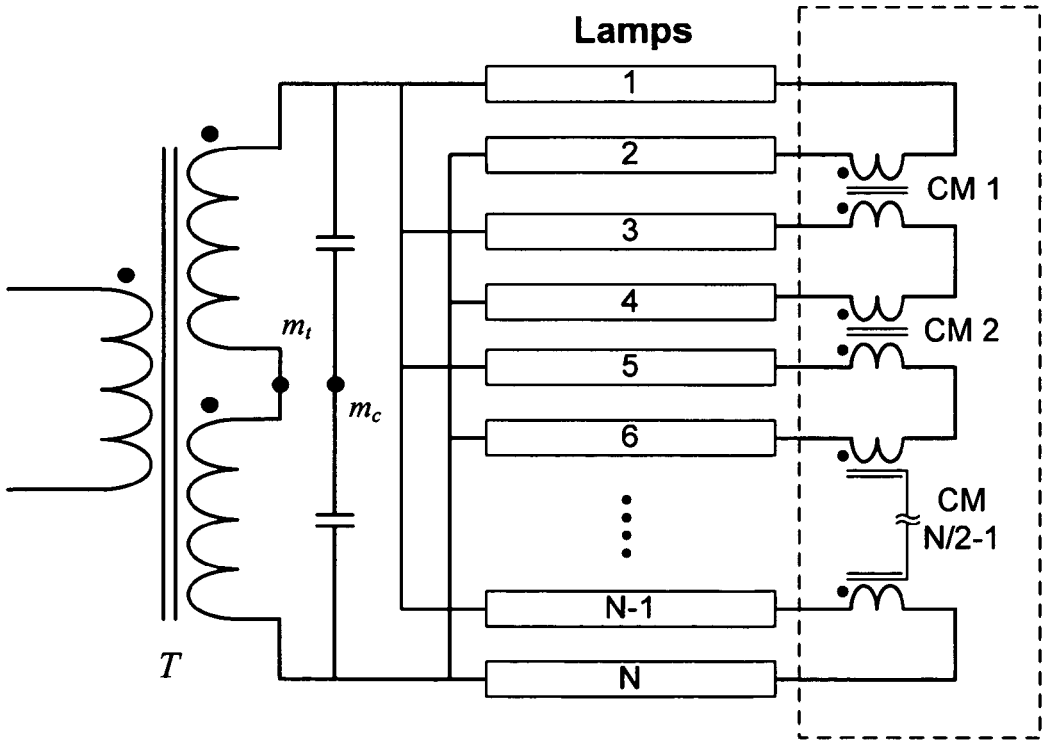
(B) The number of CMCs = (N/2)-1
*FIG. 11* Multi-lamp current balancing methods with common mode chokes.

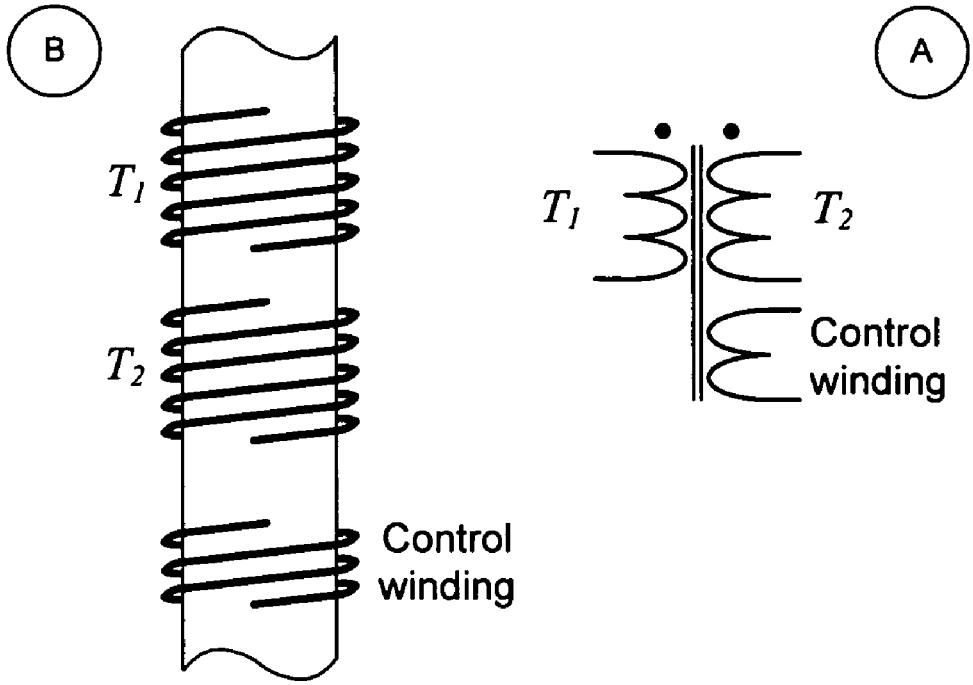
*FIG. 12* Control winding on a CMC magnetic core.
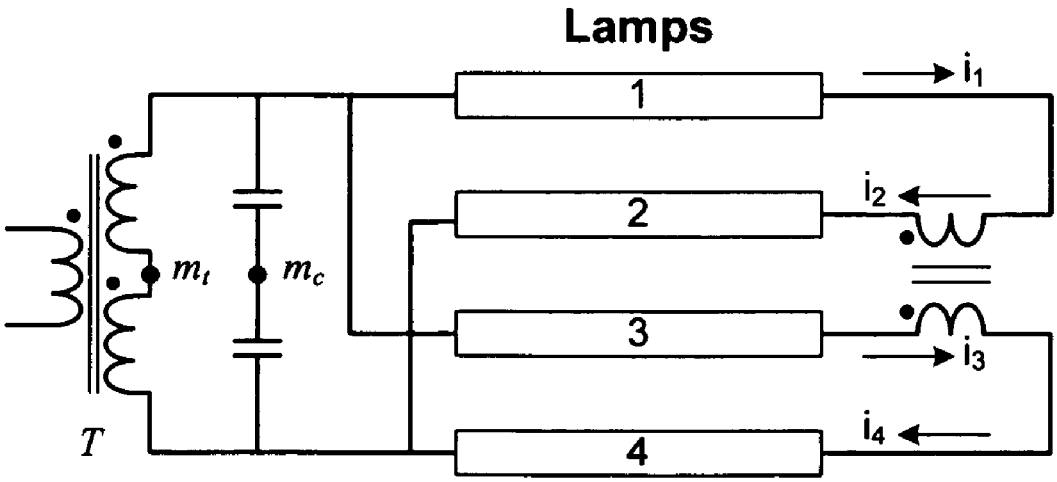
*FIG. 13* Current balancing circuit for 4 lamps.

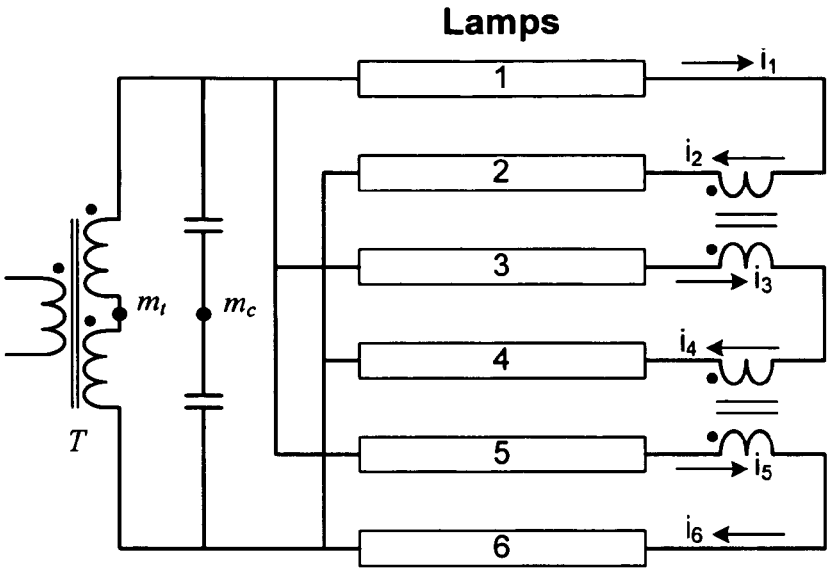
(A) 6 lamps with two common mode chokes
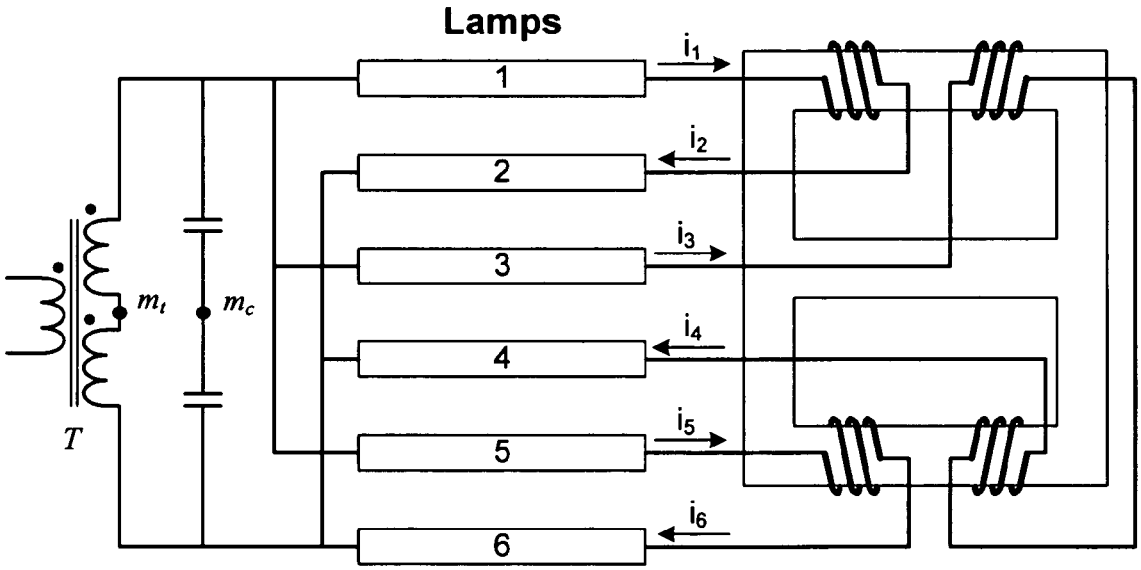
(B) 6 lamps with an integrated EE Type single magnetic
*FIG. 14*
Current balancing methods for 6 lamps.

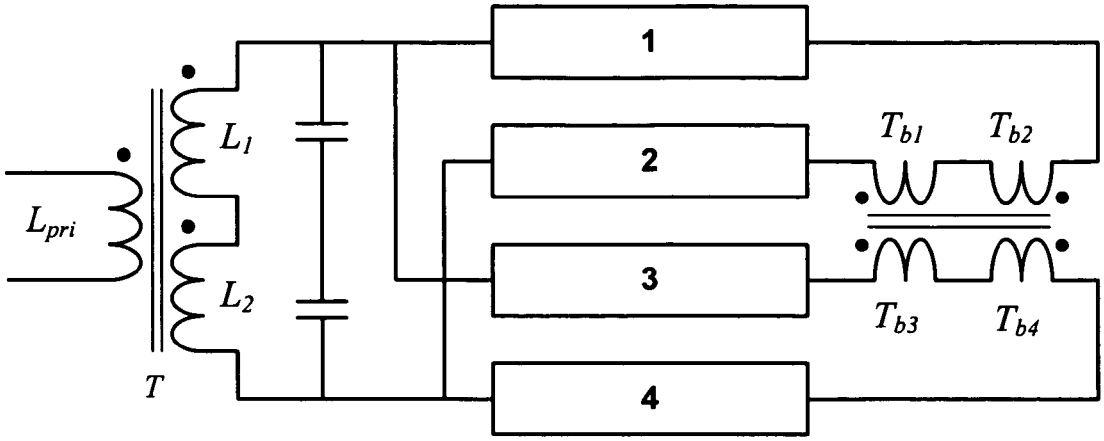
(A) Circuit
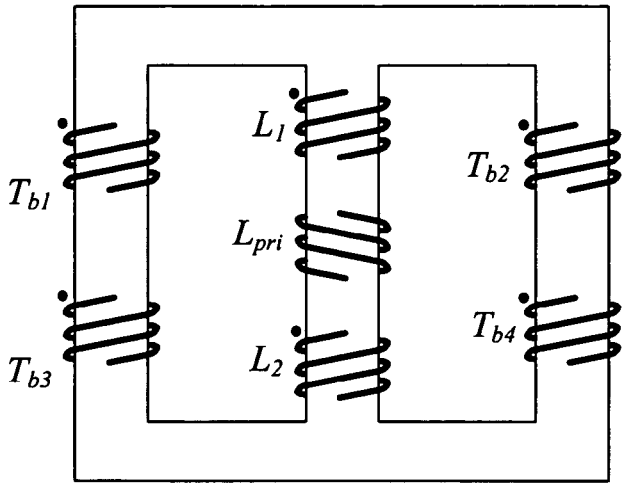
(B) Single magnetic structure implementing circuit A
*FIG. 15*
Integrated solution with 4 lamps.

Current balancing method with a CMC

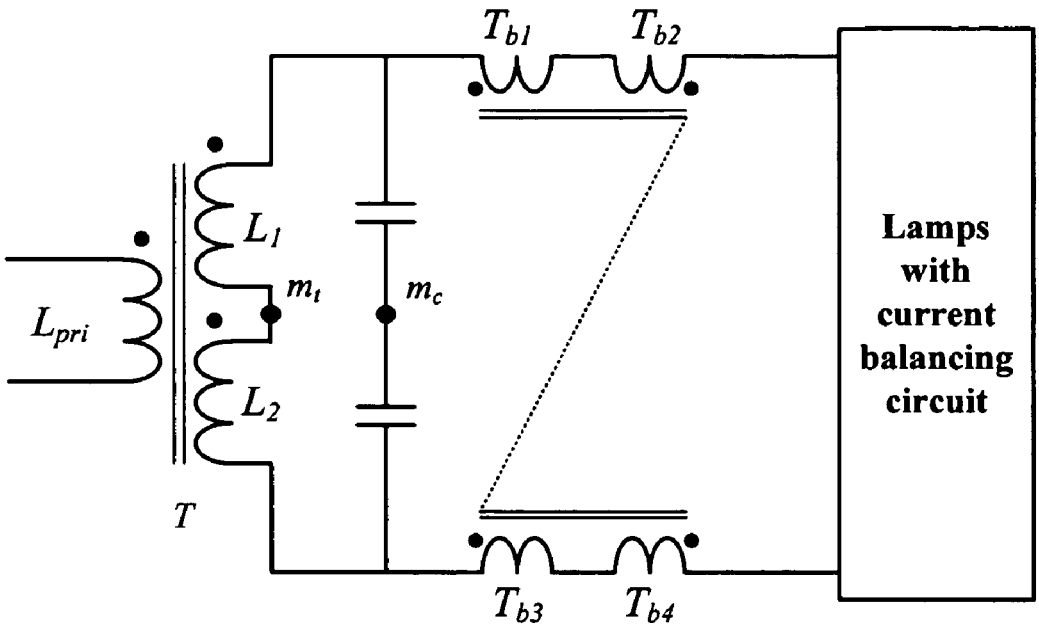
(A)
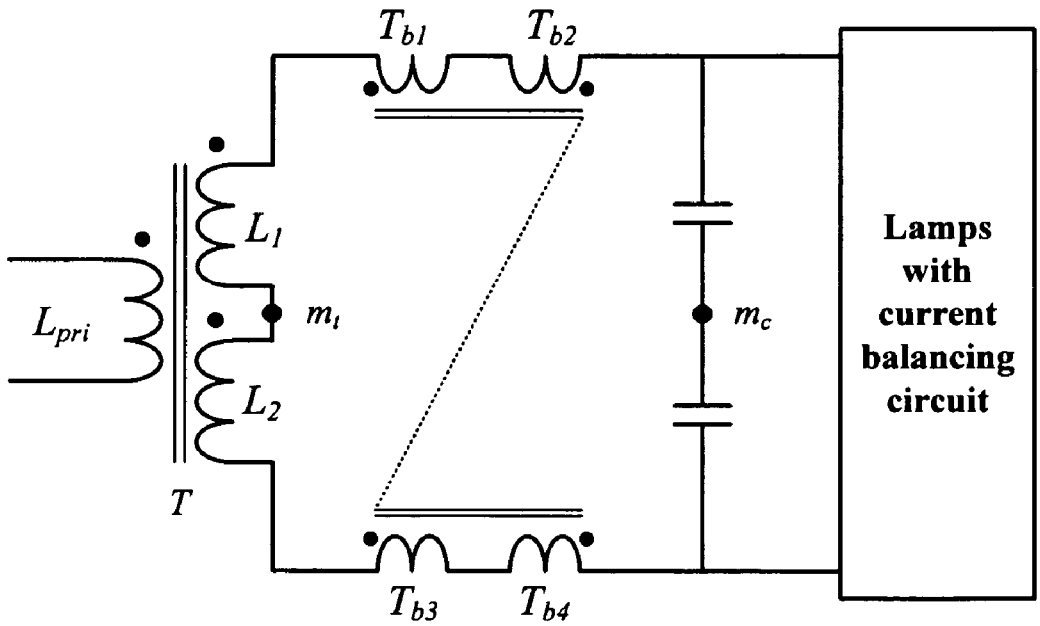
(B)
*FIG. 17*
Integrated transformer for current balancing.

Current balancing with a coupled inductor.

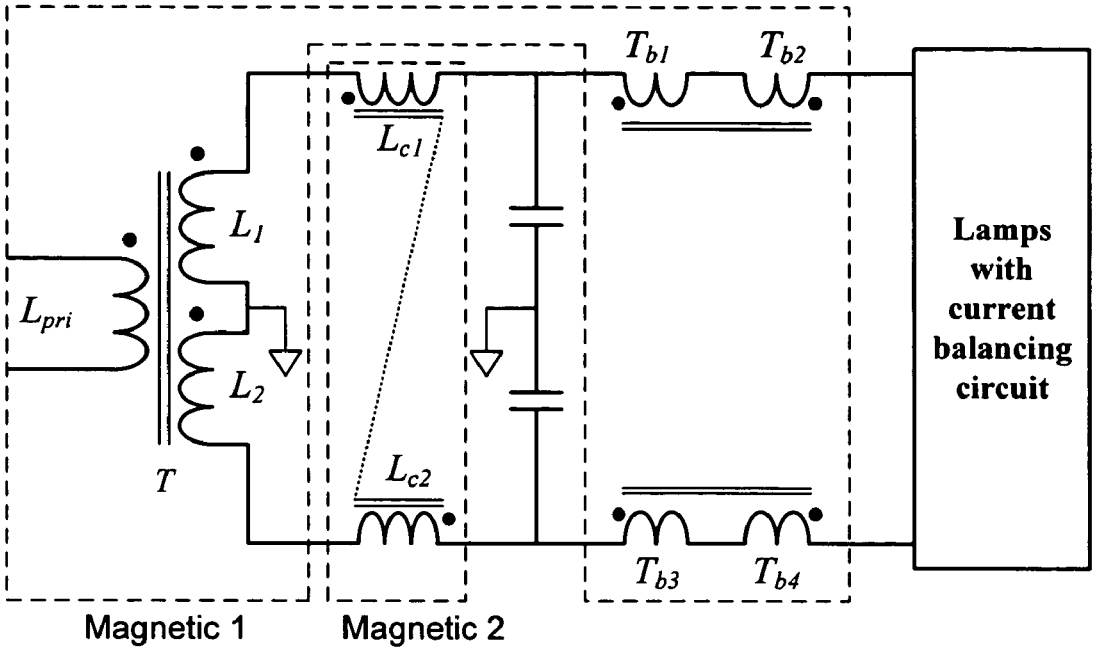
(A)
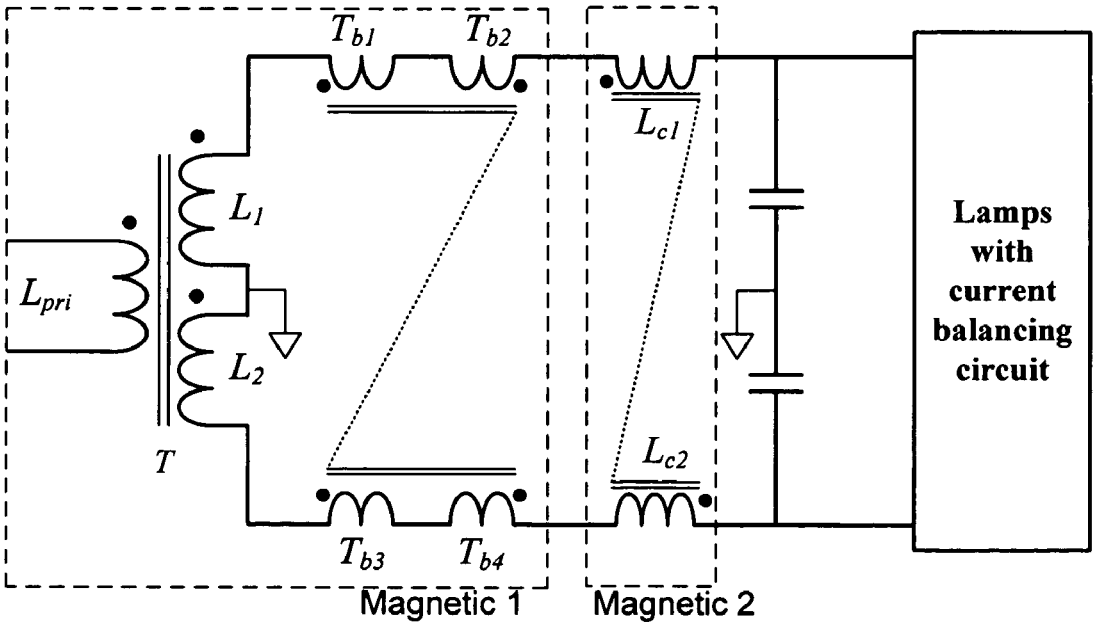
(B)
*FIG. 19*
Current balancing with an integrated transformer and a coupled inductor.

EQUALIZING DISCHARGE LAMP CURRENTS IN CIRCUITS

CROSS-REFERENCE TO RELATED APPLICATION

This application is a Continuation-In-Part of U.S. patent application Ser. No. 11/176,804, entitled "Current Balancing Technique with Magnetic Integration for Fluorescent Lamps," filed Jul. 6, 2005.

TECHNICAL FIELD

The embodiments described below relate, particularly, to current balancing in Cold Cathode Fluorescent Lamps (CCFLs) and, generally, to current balancing in multiple parallel branches of a circuit.

BACKGROUND

Fluorescent lamps provide illumination in typical electrical devices for general lighting purposes and are more efficient than incandescent bulbs. A fluorescent lamp is a low pressure gas discharge source, in which fluorescent powders are activated by an arc energy generated by mercury plasma. When a proper voltage is applied, an arc is produced by current flowing between the electrodes through the mercury vapor, which generates some visible radiation and the resulting ultraviolet excites the phosphors to emit light. In fluorescent lamps two electrodes are hermetically sealed at each end of the bulb, which are designed to operate as either "cold" or "hot" cathodes or electrodes in glow or arc modes of discharge operation.

Cold cathode fluorescent lamps (CCFLs) are popular in backlight applications for liquid crystal displays (LCDs). Electrodes for glow or cold cathode operation may consist of closed-end metal cylinders that are typically coated on the inside with an emissive material. The current used by CCFLs is generally on the order of a few milliamperes, while the voltage drop is on the order of several hundred volts.

CCFLs have a much longer life than the hot electrode fluorescent lamps as a result of their rugged electrodes, lack of filament, and low current consumption. They start immediately, even at a cold temperature, and their life is not affected by the number of starts, and can be dimmed to very low levels of light output. However, since a large number of lamps are required for large size LCDs, balanced current sharing among lamps is required for achieving uniform backlight and long lamp life.

One means of current balancing is to drive each lamp with an independently controlled inverter, which achieves high accuracy in current sharing; however, this approach is usually complicated and expensive. Another solution is to drive all lamps with a single inverter. FIG. 1 depicts a multi-CCFL system comprising a low voltage inverter, a step-up transformer, and current balancing transformers. This technique is more cost effective. Currently there are a few current balancing transformer techniques, two of which are shown in FIGS. 2A and 2B. In these designs, the current balancing is not available under open lamp condition.

BRIEF DESCRIPTION OF THE DRAWINGS

FIGS. 2A and 2B illustrate prior art multi-lamp current balancing systems.

FIGS. 4A and 4B illustrate structures of two integrated transformers with 3-leg magnetic core, in accordance with two other embodiments of the invention.

FIGS. 11A and 11B illustrate current balancing methods using common mode chokes (CMCs).

FIGS. 12A and 12B illustrate winding details of the CMCs shown in FIGS. 11A and 11B.

FIG. 13 illustrates a current balancing method for 4-lamp application using a single CMC.

FIG. 14A shows a current balancing method for 6-lamp application using two CMCs, and FIG. 4B shows an integration method of implementing the CMCs of FIG. 14A with a single magnetic.

FIGS. 15A and 15B show a method for integration of transformer and CMC of FIG. 13 into a single magnetic.

FIGS. 17A and 17B show a current balancing method for a circuit such as the one shown in FIG. 16, using a single magnetic core on which a main transformer and CMCs are wound.

FIGS. 19A and 19B show a lamp current balancing method with an integrated magnetic core implementing a main transformer and CMCs.

DETAILED DESCRIPTION

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail, so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this Detailed Description section.

The embodiments described in this detailed description generally employ a single multiple-legged transformer with multiple windings, making it a simple and accurate circuit to achieve balanced currents through all participating lamps and to reject unwanted parasitic and harmonics. A few of the advantages of the presented embodiments are accurate current balancing, reduction of the number of magnetic cores, low manufacturing cost, small size, and current balancing under open lamp conditions.

Figure 1:
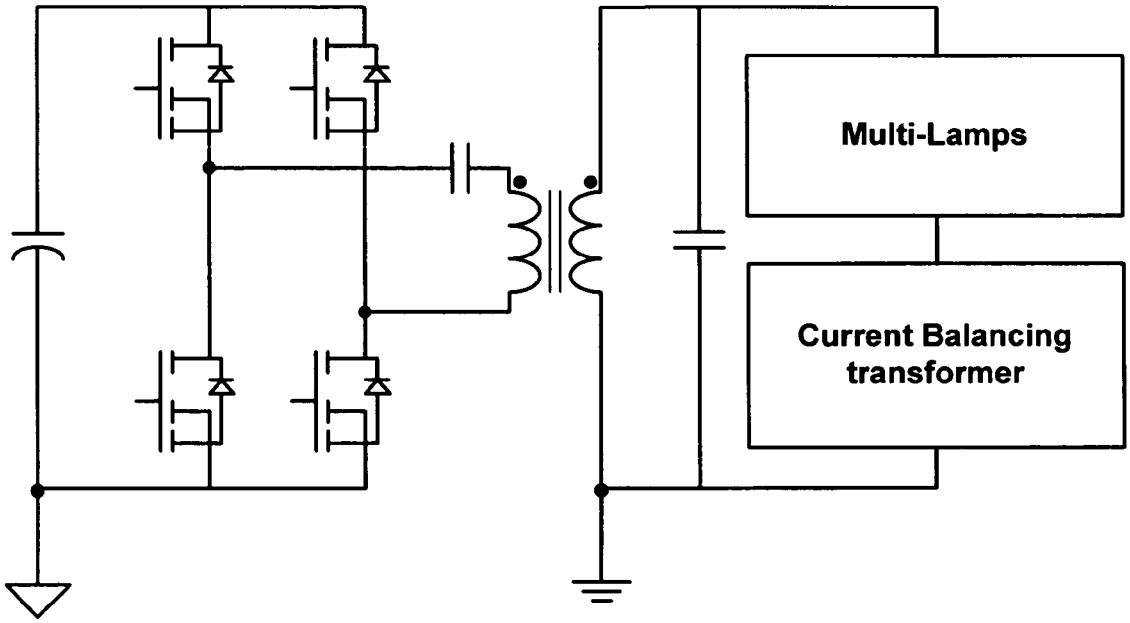
FIG. 1 illustrates a multi-lamp system driven by a single inverter.
Figure 3:
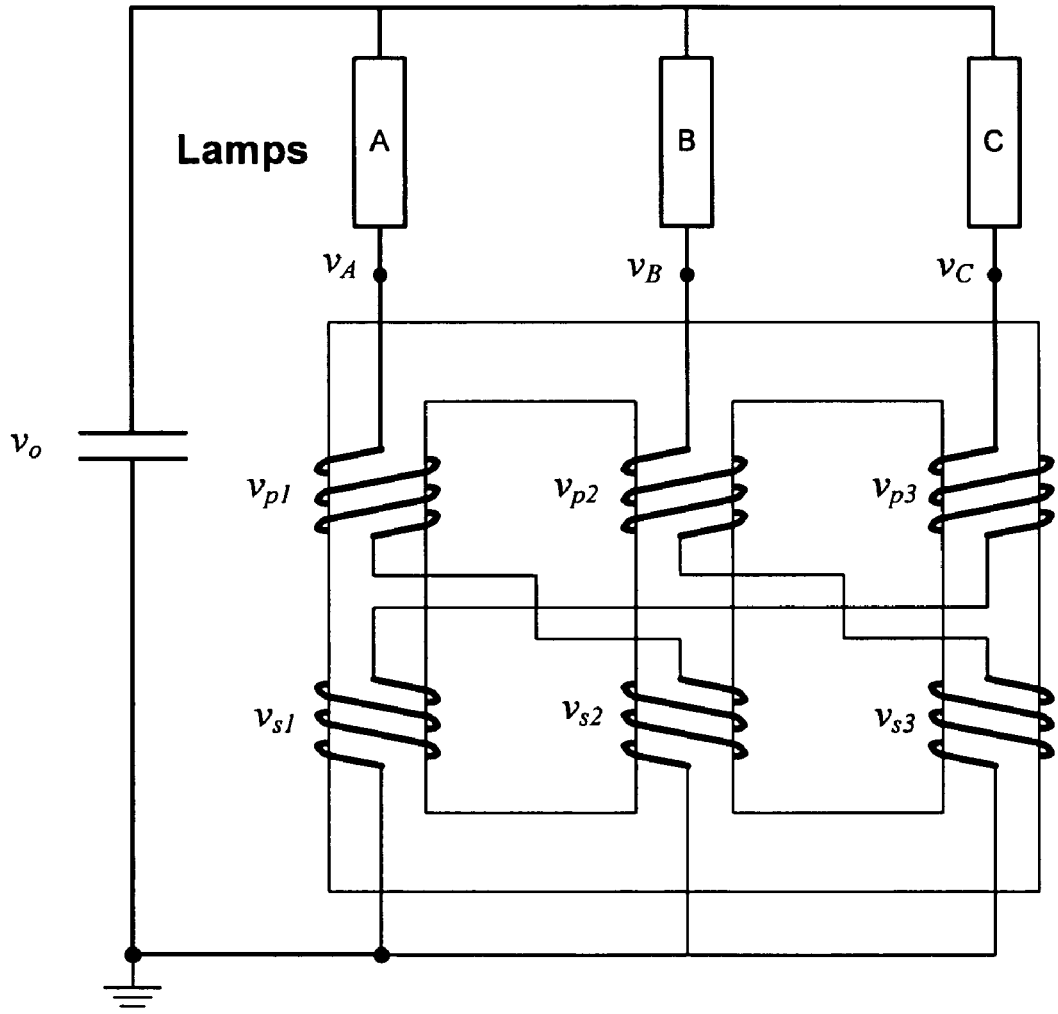
FIG. 3 illustrates an exemplary current balancing technique for multi-lamp systems, in accordance with an embodiment of the invention.

FIG. 3 shows a current balancing circuit with a zig-zag connection to balance currents passing through the lamps of a 3-lamp system. From FIG. 3, assuming that the three transformers (one on each leg) are ideal and turns ratio is 1:1, two winding voltages on the same magnetic core have the following relationship:

$$v_{p1}=-v_{s1}$$

$$v_{p2}=-v_{s2}$$

$$v_{p3}=-v_{s3} \tag{1}$$

The voltage equations on the terminals A, B, and C are:

$$\begin{bmatrix} v_A \\ v_B \\ v_C \end{bmatrix} = \begin{bmatrix} v_{p1}+v_{s2} \\ v_{p2}+v_{s3} \\ v_{p3}+v_{s1} \end{bmatrix} = \begin{bmatrix} v_{p1}-v_{p2} \\ v_{p2}-v_{p3} \\ v_{p3}-v_{p1} \end{bmatrix} = \begin{bmatrix} 1 & -1 & 0 \\ 0 & 1 & -1 \\ -1 & 0 & 1 \end{bmatrix} \begin{bmatrix} v_{p1} \\ v_{p2} \\ v_{p3} \end{bmatrix} \tag{2}$$

and therefore:

$$v_A+v_B+v_C=0, \tag{3}$$

and $$v_{p1}+v_{p2}+v_{p3}=0. \tag{4}$$

From equation (4) it can be concluded that three separate transformers may be integrated together to provide a more compact and a less expensive solution. The resulting transformer is a kind of autotransformer that does not provide isolation. In one embodiment the cross section of the three legs are identical and each leg has two windings and the connections are made according to FIG. 3. The magnetic core can be an EE type core since it is the most commonly used. In other embodiments, other types of balanced three leg cores may be used for achieving a balanced inductance on each leg.

FIG. 4 illustrates a three-legged integrated transformer structure with two different winding options. In one option, as shown in FIG. 4A, all legs have windings, while in the second option, as shown in FIG. 4B, only two of the three legs have windings. Note that for the current in the three lamps to be balanced, the leg without winding does not have to be balanced with the other two legs. Therefore any available EE type magnetic core can be used for this option.

Figure 5:
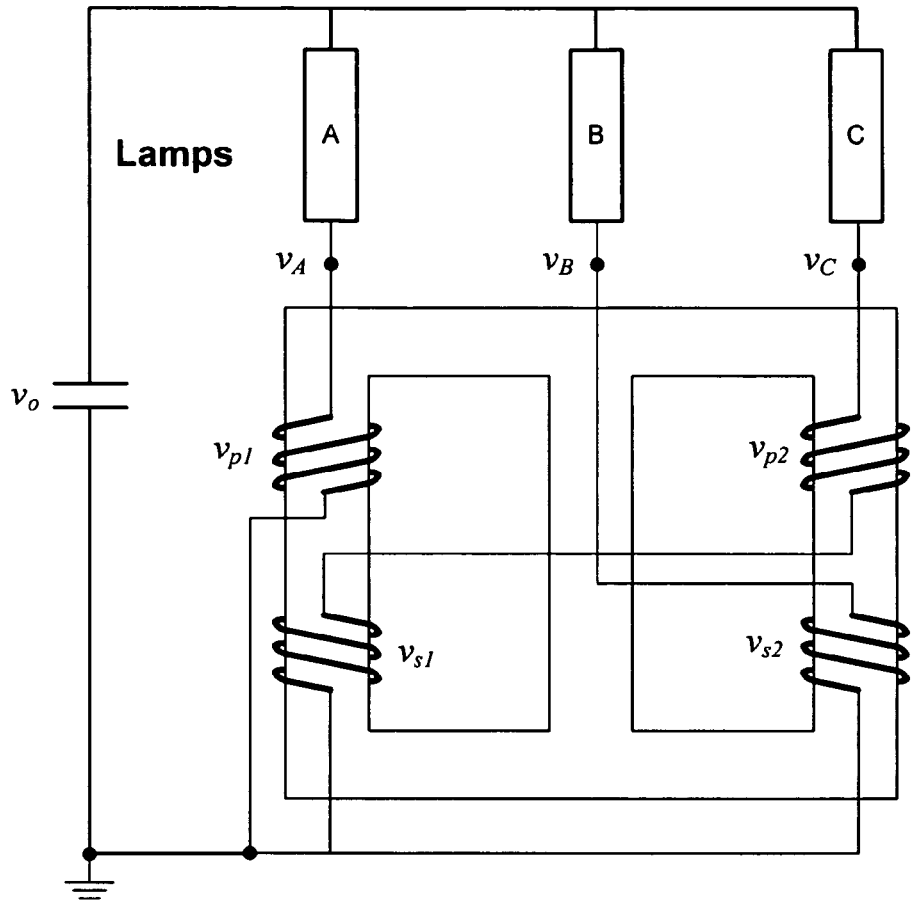
FIG. 5 illustrates an example of a 4-winding 3-Lamp current balancing technique with a single magnetic core, in accordance with yet anther embodiment of the invention.

FIG. 5 shows winding details of an embodiment, which is similar to the embodiment depicted in FIG. 4B, wherein only two legs of the integrated magnetic core have windings. This embodiment provides current balancing for a 3-lamp system.

Figure 6:
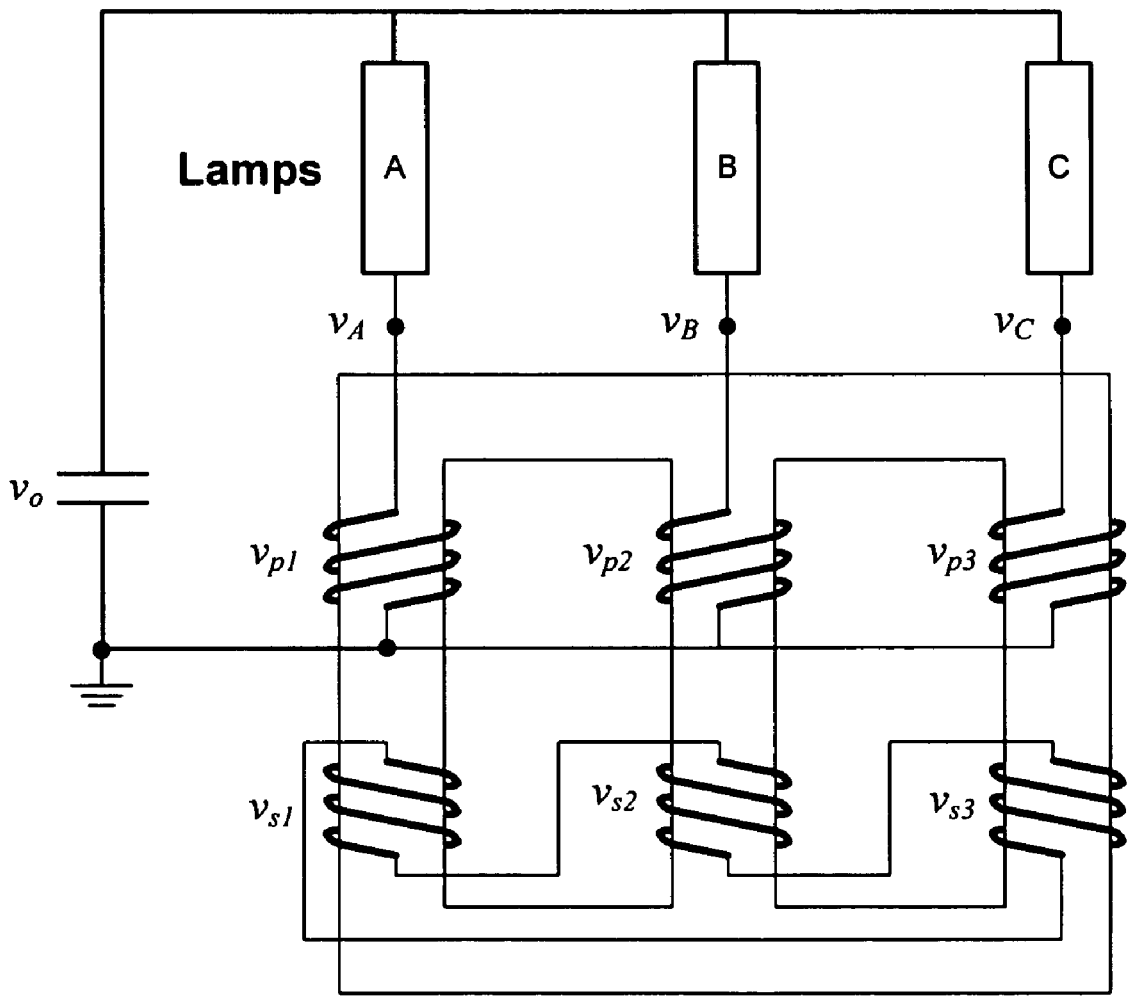
FIG. 6 illustrates a star-delta configuration of a 3-Lamp current balancing technique, using a single magnetic core, in accordance with yet anther embodiment of the invention.

FIG. 6 shows winding details of an alternative current balancing transformer with a star-delta connection for balancing the current in a 3-lamp system. As seen in FIG. 6, the magnetic core in this embodiment is also integrated. The turn-ratio of the transformer is not necessarily 1 to 1.

Figure 7:
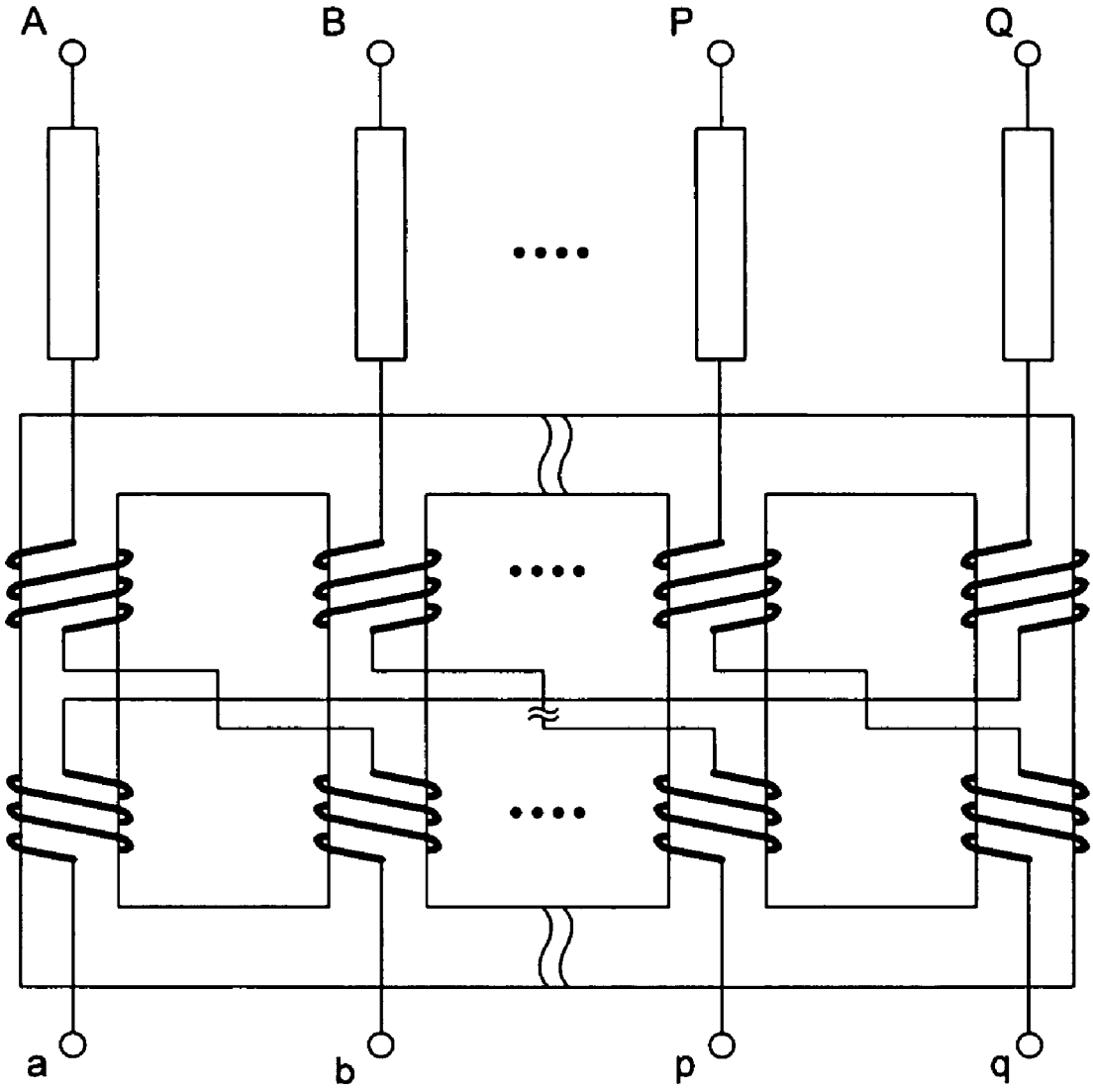
FIG. 7 illustrates a multi-leg magnetic core with zig-zag connection for current balancing in a multi-lamp system.

FIG. 7 shows that the proposed techniques of current balancing can be extended to more than 3-lamp systems by using integrated magnetic cores with more than 3 legs and zig-zag connection. Note that terminals A, B, . . . , P, and Q can be either directly connected to a high voltage capacitor or separately connected to several different capacitors. Therefore, the voltages on the terminals can either be common or phase-shifted or interleaved. In another embodiment, terminals a, b, . . . , p, and q are connected to the ground.

Figure 8:
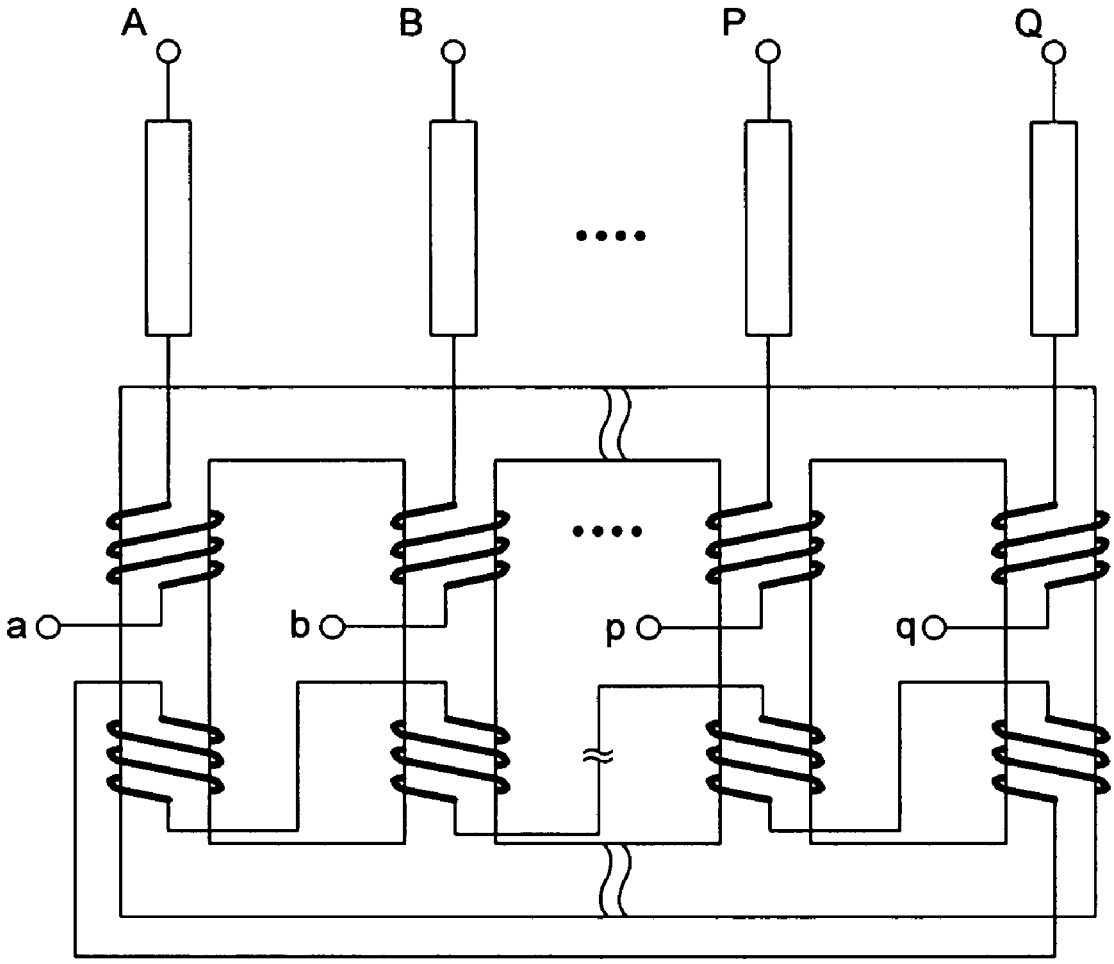
FIG. 8 illustrates a multi-leg magnetic core with star-delta connection for current balancing in a multi-lamp system.

FIG. 8 illustrates a magnetic core with more than three legs and unconnected windings that can be either connected in accordance with the general winding principles disclosed in FIG. 6. Note that terminals A, B, . . . , P, and Q can be either directly connected to a high voltage capacitor or separately connected to several different capacitors. Therefore, the voltages on the terminals could be either common or phase-shifted or interleaved. In another embodiment, terminals a, b, . . . , p, and q are connected to the ground.

In most embodiments with substantially identical leg cross sections the primary windings of the legs are substantially similar to each other and the secondary windings of the legs are also substantially similar to each other. Furthermore, all connections of the two windings of each leg are similar to the connections of the two windings of any other leg. However, the primary and the secondary windings of each leg are wound in opposite directions. In the following paragraphs, to simplify the description of different transformers, all windings which are shown to have been wound in one direction are called the primary windings, and those windings which are in an opposite direction are called the secondary windings.

In some embodiments the secondary windings of all legs are connected in series and form a loop, while one end of each primary winding is connected to one end of a respective lamp and the other end of each primary winding is connected to the ground. In some of the other embodiments the primary winding of each leg is connected at one end to one end of a lamp and at the other end to one end of the secondary winding of another leg, and the other end of the secondary windings of the legs are connected to ground. The connections of the 4-winding arrangement of FIG. 5 is an exception to these general directives; however, like other described windings, the inductance is balanced in all wound legs.

Figure 9:
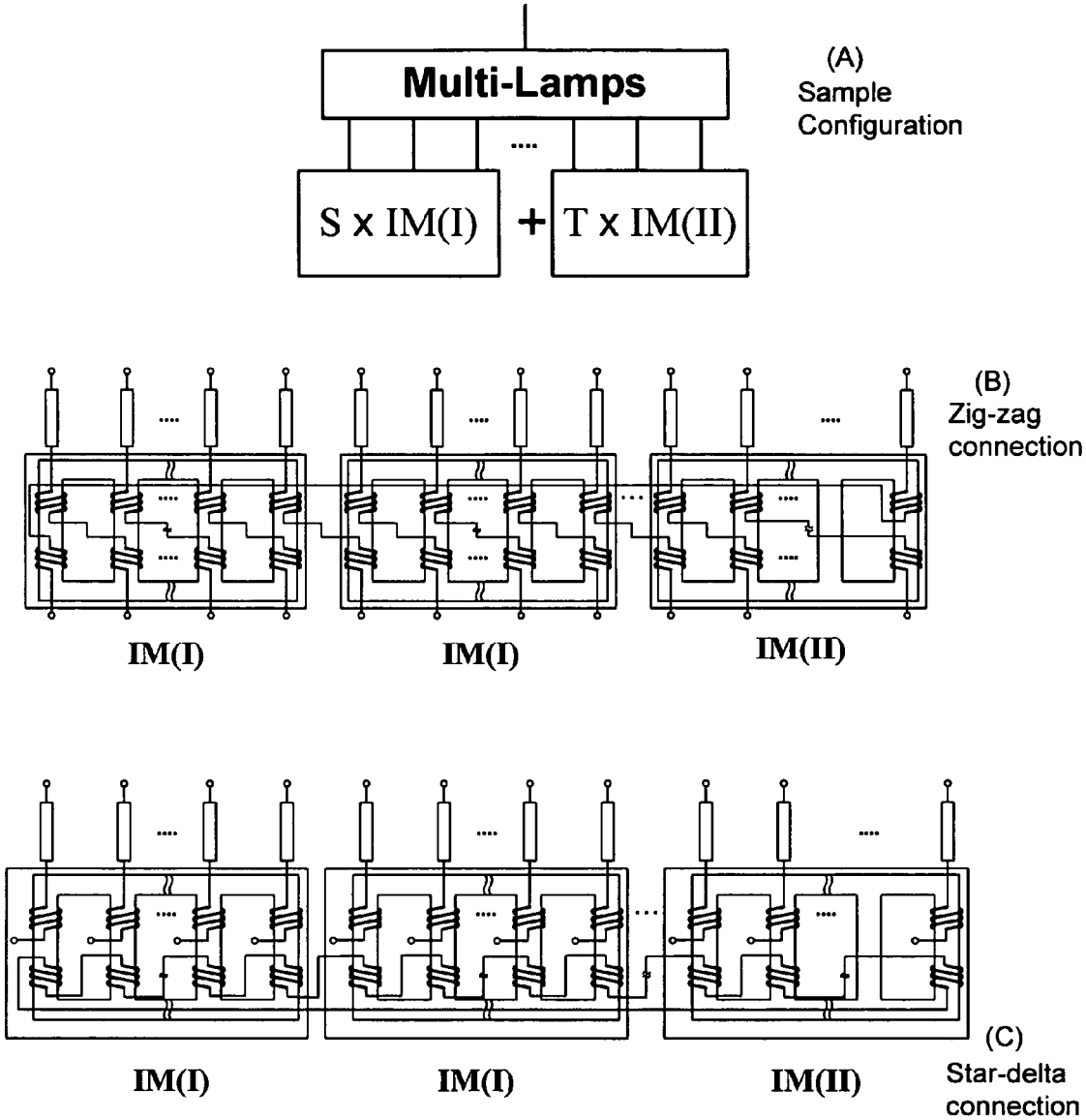
FIGS. 9A, 9B and 9C illustrate transformer configurations for balancing the current in more than three parallel lamps, using several multi-legged transformers with different windings, in accordance with other alternative embodiments of the invention.

Since it is difficult to manufacture a transformer with a large number of core legs for driving many parallel lamps, several different transformers with smaller number of legs, such as the readily available 3-leg EE type cores, can be utilized for current balancing. FIG. 9A illustrates an example of such arrangement in which at least 3-leg magnetic cores, with two windings on all legs, IM (I), or on less than all legs but more than one leg, IM (II), are used to power and balance the currents of a system with many parallel lamps. FIGS. 9B and 9C show an example of a zig-zag and a star-delta connection for the arrangement schematically illustrated in FIG. 9A. In the exemplary FIGS. 9B and 9C, S is the number of the IM (I) cores and T is the number of the IM (II) cores. Note that more than two types of cores and/or windings may be used to drive multiple parallel lamps.

Figure 10:
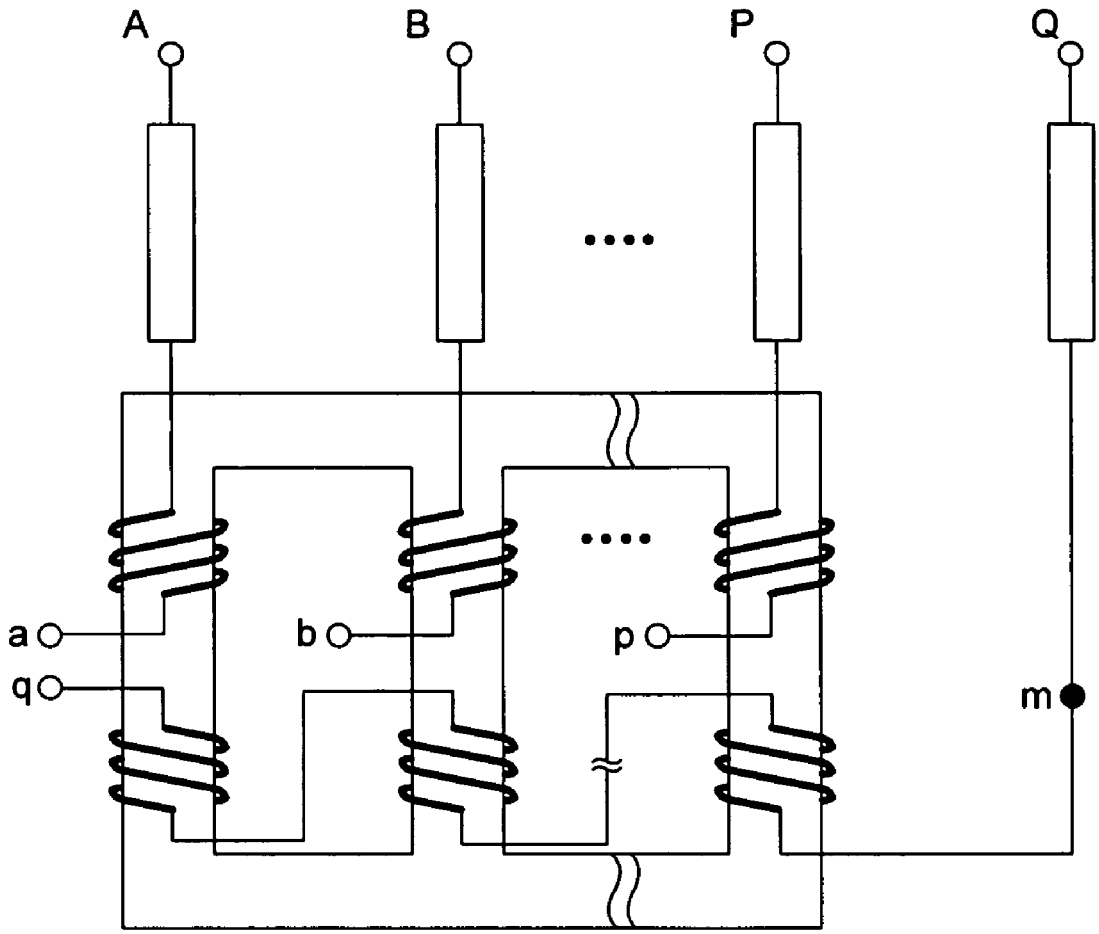
FIG. 10 shows a multi-leg magnetic core with star-open-delta connection to balance currents in more lamps than total number of magnetic core legs, in accordance with yet anther embodiment of the invention.

FIG. 10 illustrates an N-leg magnetic core with star-open-delta connection to balance currents in N+1 lamps, in accordance with yet anther embodiment of the invention. In this embodiment, the first and the second windings are configured such that the first winding of each of the N wound legs, from one similar end, is connected to one of N lamps and from another end to the ground, and the second windings of the wound legs are connected in series, wherein one end of the winding series is connected to the (N+1)th lamp and the other end of the winding series is connected to the ground.

FIG. 11A shows a current balancing method using common mode chokes (CMCs). The circuit consists of a main transformer, capacitors, lamps, and CMCs. The center-taps $m_t$ and $m_c$ of the transformer, T, secondary windings and capacitors C1 and C2 may be either grounded or floating. As shown in FIG. 11A, the number of CMCs required for the circuit is N/2 ($CM_1$ through $CM_{N/2}$). Because the CMCs force the following relations between the instantaneous loop currents:

$$i_1=i_N, i_2=i_3, i_4=i_5, \ldots, i_{N-2}=i_{N-1}, \quad (5)$$

and because:

$$i_1=i_2, i_3=i_4, i_5=i_6, \ldots, i_{N-1}=i_N, \quad (6)$$

therefore, $$i_1=i_2=i_3=i_4=i_5, \ldots, i_{N-1}=i_N. \quad (7)$$

FIG. 11B illustrates a similar current balancing method; however, the number of CMCs required for the circuit shown in FIG. 11B is (N/2)−1 ($CM_1$ through $CM_{N/2-1}$). Furthermore, the CMCs in FIGS. 11A and 11B can either be separate or integrated, as described above, offering different advantages. By using the methods illustrated in FIGS. 11A and 11B, the number of CMCs for driving N lamps is reduced to N/2 or (N/2)−1. In other embodiments every several lamps may use an integrated core; for example every six lamps may use a 3-legged EE type core.

FIGS. 12A and 12B illustrate the winding details of a CMC, in accordance with yet another embodiment of the invention. $T_1$ and $T_2$ are the CMC primary and secondary windings, respectively, with an added control winding. The existence of a voltage across the control winding is an indication of an abnormal circuit function, since under normal conditions, due to the flux cancellation, there should be no potential difference across the control winding. For example, under an open lamp loop condition, a voltage will be detected across this small control winding, which simplifies fault protection while the control winding is inexpensive and easy to manufacture.

FIG. 13 shows a current balancing method for a 4-lamp application, using a single CMC while the existing current balancing methods for a 4-lamp application use four CMCs. The circuit shown in FIG. 13 provides good performance at a low cost. In one embodiment the CMC for a 4-lamp application uses readily available EE type cores. For the same reason illustrated by equations (5), (6), and (7), the instantaneous currents in the four lamps shown in FIG. 13 are equal.

FIG. 14A shows a method of current balancing for a 6-lamp application. This method only uses two CMCs. For the same reason illustrated by equations (5), (6), and (7), the instantaneous currents in the six lamps shown in FIG. 14A are equal. FIG. 14B illustrates an integrated method of implementing the CMCs of FIG. 14A. As shown in FIG. 14B, the two CMCs are wound on a same magnetic core; in this case an EE type. In an alternative embodiment, a control winding is placed on the center leg of the EE core to detect defects such as an open lamp condition. The method disclosed in this embodiment reduces the number of CMCs required for balancing current in the lamp loops.

FIG. 15A illustrates a method of integrating the transformer T and the CMC of FIG. 13 onto a single magnetic, to achieve current balancing. The integrated magnetic includes all windings shown in FIG. 15A: $L_{pri}$, $L_1$, $L_2$, $T_{b1}$, $T_{b2}$, $T_{b3}$, and $T_{b4}$, where $L_{pri}$ is the primary winding of the main transformer T, $L_1$ and $L_2$ are the secondary windings and $T_{b1}$, $T_{b2}$, $T_{b3}$, and $T_{b4}$ are the CMC windings for current balancing. FIG. 15B shows the magnetic core and detail winding connections. One of the advantages of this embodiment is the simplicity of the required magnetic core and its associated cost.

Figure 16:
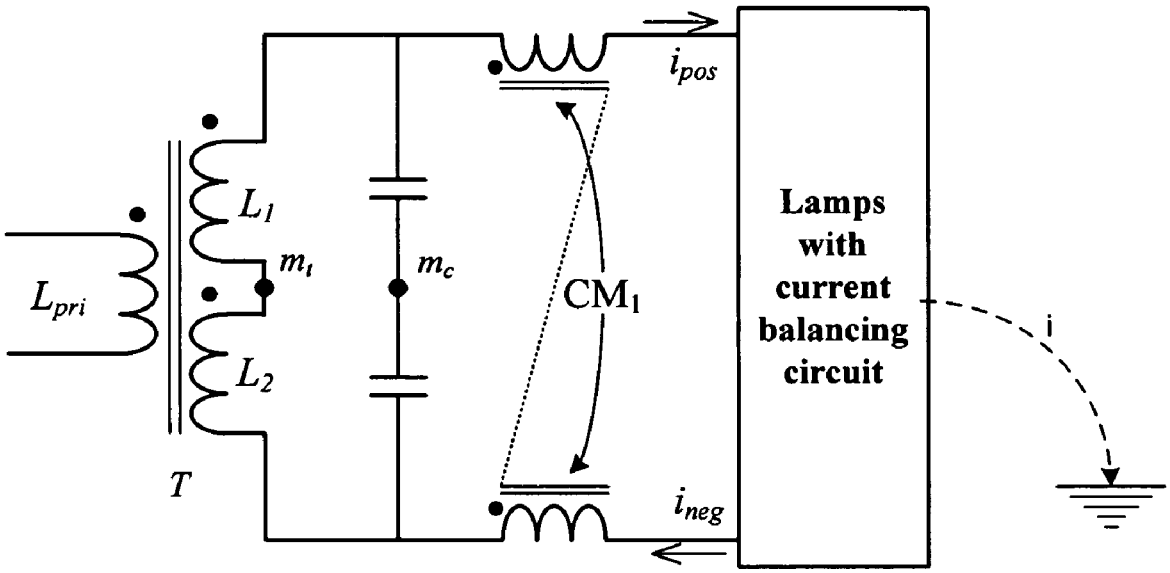
FIG. 16 shows a current balancing method for multiple loads, using a single CMC.

FIG. 16 shows a method of leakage prevention for multiple parallel lamps, using a single CMC, wherein the multiple parallel lamps may or may not use additional current balancing means. Ideally, the current entering the lamps ($I_{pos}$) must be equal to the current exiting the lamps ($I_{neg}$); however, with long lamps there may be a leakage current at high frequencies from the lamps to ground (e.g., earth or chassis), due to a capacitor coupling between the lamps and the ground. In the disclosed configuration of FIG. 16, the common mode choke $CM_1$, balances $I_{pos}$ and $I_{neg}$ currents in an effort to minimize the leakage.

FIGS. 17A and 17B show a current balancing and leakage minimization method, similar to the one illustrated in FIG. 16, employing a single magnetic core on which the main transformer T and the CMCs are wound, wherein the winding connections are made according to FIG. 15B. The CMCs are placed either in series with the lamps, as shown in FIG. 17A, or with the transformer secondary winding, as shown in FIG. 17B.

Figure 18:
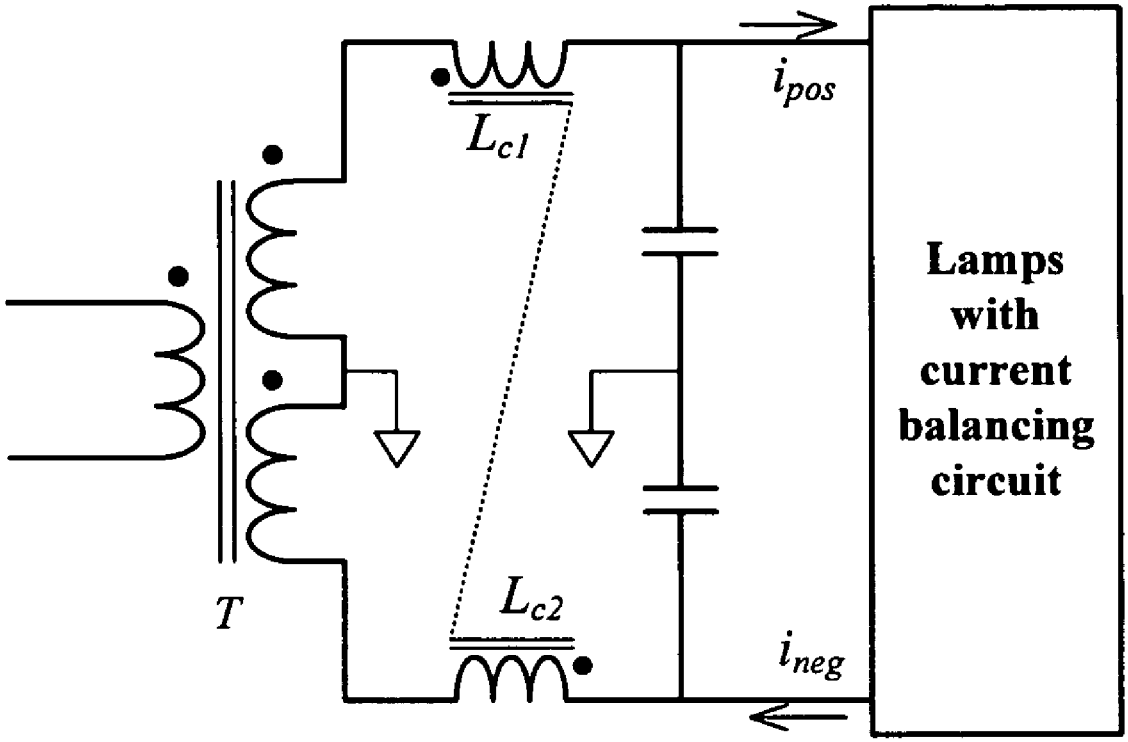
FIG. 18 shows a current balancing method using a coupled inductor.

FIG. 18 shows a current balancing method with a coupled inductor, $L_{c1}$ and $L_{c2}$. Typically, the main transformer T includes enough leakage inductance for CCFL applications, while the leakage fluxes flow through air and generate loss, which is extremely high at high power levels. In this embodiment of the invention, the main transformer T has a lower leakage inductance but the coupled inductor helps the transformer to form an adequate resonant tank while equalizing lamp currents ($I_{pos}$ and $I_{neg}$) by providing identical voltages across the two windings. This improves efficiency at high power settings.

FIGS. 19A and 19B show a lamp current balancing method with an integrated magnetic core for the main transformer T and the CMCs to improve performance. This embodiment combines the advantages offered by the embodiments depicted in FIGS. 17 and 18. The dashed lines in FIGS. 19A and 19B illustrate two possible integration options for reducing cost and space, and for simplifying manufacturing.

It is important to note that the aspects of this invention can be applied to all kinds of loads that can benefit from balanced currents in their circuit loops, utilizing inexpensive solutions which fully exploit magnetic circuits, their manufacturing, and their integration with electronic components and ICs.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof.

Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The above detailed description of embodiments of the invention is not intended to be exhaustive or to limit the invention to the precise form disclosed above. While specific embodiments of, and examples for, the invention are described above for illustrative purposes, various equivalent modifications are possible within the scope of the invention, as those skilled in the relevant art will recognize.

The teachings of the invention provided herein can be applied to other systems, not necessarily the system described above. The elements and acts of the various embodiments described above can be combined to provide further embodiments.

Changes can be made to the invention in light of the above Detailed Description. While the above description describes certain embodiments of the invention, and describes the best mode contemplated, no matter how detailed the above appears in text, the invention can be practiced in many ways. Details of the compensation system described above may vary considerably in its implementation details, while still being encompassed by the invention disclosed herein.

As noted above, particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention under the claims.

While certain aspects of the invention are presented below in certain claim forms, the inventors contemplate the various aspects of the invention in any number of claim forms. Accordingly, the inventors reserve the right to add additional claims after filing the application to pursue such additional claim forms for other aspects of the invention.

We claim:

1. An apparatus for balancing a current entering a load with a current exiting the load to minimize current leakage of the load, the apparatus comprising:

an electrical source; and a common mode choke (CMC), connected between the load and the electrical source such that a first winding of the CMC is connected between a first end of the electrical source and a first end of the load;

a second winding of the CMC is connected between a second end of the electrical source and a second end of the load; and the first and second windings of the CMC are wound in series in a zig-zag configuration on the same CMC such that if an instantaneous current in one winding is towards the load, the instantaneous current of the other winding is away from the load.

2. The apparatus of claim 1, wherein the load is a plurality of balanced or unbalanced parallel lamps or parallel loads.

3. The apparatus of claim 1, wherein the electrical source is current source which is a secondary winding of a transformer and a capacitance is connected between the two poles of the secondary of the transformer.

4. The apparatus of claim 1, wherein the electrical source is a current source which further comprises a secondary winding of a transformer, and further comprises a 3-leg EE type magnetic core for integrating the primary and the secondary windings of the transformer and the windings of the CMC.

5. The apparatus of claim 1, wherein:

the CMC further comprises a coupled inductor;

two capacitors in series are connected between the input and the output of the load; and wherein the midpoint of the secondary winding of the transformer and the midpoint of the two series capacitors are grounded.

6. A system for balancing a current entering a load with a current exiting a load to minimize current leakage from the load, the system comprising:

an electrical source;

a first series connection including a first winding of a coupled inductor and a first winding of a common mode choke (CMC), connected in series between a first pole of the electrical source and a first end of the load; and a second series connection including a second winding of the coupled inductor and a second winding of the CMC, connected in series between a second pole of the electrical source and a second end of the load;

wherein the first and second windings of the coupled inductor and the CMC are wound in series and in a zig-zag configuration such that if an instantaneous current in one series connection is towards the load, the instantaneous current in the other series connection is away from the load.

7. The system of claim 6, wherein the load is a plurality of balanced or unbalanced parallel lamps or parallel loads.

8. The system of claim 6, wherein the electrical source comprises a secondary winding of a transformer, wherein the midpoint of the secondary winding of the transformer is grounded, wherein two capacitors in series are connected between the input and the output of the load or between the midpoints of the series connections and wherein the midpoint of the series capacitors is grounded, and wherein the primary and the secondary windings of the transformer and the windings of the CMC are integrated on a single magnetic core and the coupled inductor uses another magnetic core.

9. The system of claim 6, wherein the electrical source is a current source which includes a secondary winding of a transformer and the midpoint of the secondary winding of the transformer is grounded, and wherein two capacitors in series are connected between the input and the output of the load or between the midpoints of the series connections and wherein the midpoint of the series capacitors is grounded.

10. The system of claim 9, further comprising a 3-leg EE type magnetic core for integrating the primary and the secondary windings of the transformer and the windings of the CMC.

11. A method for balancing a current entering a load with a current exiting the load, the method comprising:

passing the current entering the load through a first winding of a common mode choke (CMC), a first winding of a coupled inductor, or both;

passing the current exiting the load through a second winding of the CMC, a second winding of the coupled inductor, or both; and balancing the current entering the load with the current exiting the load by winding the CMC or the coupled inductor in a series and zig-zag configuration such that if an instantaneous current in the first winding of the CMC or coupled inductor is towards the load, the instantaneous current in the second winding of the CMC or coupled inductor is away from the load.

12. The method of claim 11, wherein the CMC and a transformer windings are integrated on an EE type core.

* * * * *